US010207280B2

(12) United States Patent
Lin et al.

(10) Patent No.: US 10,207,280 B2
(45) Date of Patent: Feb. 19, 2019

(54) OVERHEAD SHOWER HEAD WITH BACKSIDE SWITCH

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Fengde Lin, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 92 days.

(21) Appl. No.: 15/335,045

(22) Filed: Oct. 26, 2016

(65) Prior Publication Data

US 2017/0165683 A1 Jun. 15, 2017

(30) Foreign Application Priority Data

Dec. 10, 2015 (CN) ..... 2015 1 0915170

(51) Int. Cl.

| | |
|---|---|
| ***B05B 1/18*** | (2006.01) |
| ***B05B 1/16*** | (2006.01) |
| ***B05B 12/00*** | (2018.01) |

(52) U.S. Cl.

CPC ..... *B05B 1/1627* (2013.01); *B05B 1/18* (2013.01); *B05B 12/002* (2013.01)

(58) Field of Classification Search

CPC ..... B05B 1/18; B05B 1/185; B05B 12/002; B05B 15/654

See application file for complete search history.

(56) References Cited

U.S. PATENT DOCUMENTS

| | | | | |
|---|---|---|---|---|
| 5,937,905 | A * | 8/1999 | Santos | E03C 1/0404 137/801 |
| 8,360,346 | B2 * | 1/2013 | Furseth | B05B 15/654 239/600 |
| 9,579,667 | B2 * | 2/2017 | Evans | B05B 15/654 |
| 2014/0191064 | A1 * | 7/2014 | Erickson | B05B 1/1636 239/302 |
| 2015/0196927 | A1 * | 7/2015 | Ramos De Barros | B05B 1/3006 239/107 |

* cited by examiner

*Primary Examiner* — Alexander M Valvis

(74) *Attorney, Agent, or Firm* — Rabin & Berdo, P.C.

(57) ABSTRACT

An overhead shower head with rear switch has a main body. The front of the main body is disposed with an accommodating chamber to accommodate an outlet cover including a cover plate with a ball seat, and the rear is disposed with a switch including a dial button at an eccentric position. The main body is disposed with a through hole that accommodates a water inlet joint. The water diversion body is a water diversion ball and is disposed with two outlets to form a first function waterway and a second function waterway with the inlet joint. The switch includes a first rotating shaft disposed at an eccentric position, a dial button linked to the first rotating shaft and a sealing element linked to the dial button. Thus, the overhead shower head has a short switch route to switch the outlet functions.

1 Claim, 11 Drawing Sheets

OVERHEAD SHOWER HEAD WITH BACKSIDE SWITCH

FIELD OF THE INVENTION

The present invention relates to a shower head, especially to an overhead shower head.

BACKGROUND OF THE INVENTION

Existing overhead shower heads have several outlet functions, it usually applies a force to rotate the outlet component to switch the functions, for example, by rotating the cover plate to drive the water diversion plate to switch or by dialing a knob on the cover plate to switch. However, above mentioned switch methods need the relative rotating of the outlet component and the main body, when switched, it needs a long switch route to operate. Besides, the outlet cover plate is swinging available, to keep it still when switching, the user needs a hand to hold the outlet cover plate and the other hand to switch the outlet functions, it thus operates with no convenience, and it also faces a large resistance that results in a bad switch hand feeling.

SUMMARY OF THE INVENTION

The present invention is provided with an overhead shower head with a short switch route to switch the outlet functions to solve the primary problem.

The present invention is also provided with an overhead shower head with a stable outlet mode without fleeing even the outlet cover plate swings up and down to a limit in the horizontal plane to solve the secondary problem.

The technical proposal of the present invention is that:

An overhead shower head with backside switch, the overhead shower head has a main body; the front end of the main body is disposed with an accommodating chamber to accommodate an outlet cover component, the rear end of the main body is disposed with a dial button component at an eccentric position; the main body is disposed with a through hole in the axial direction of the main body to accommodate an inlet joint and a water diversion body; the water diversion body is disposed with two outlets to form a first function waterway and a second function waterway with the inlet joint;

the dial button component comprises a first rotating shaft disposed at an eccentric position, a dial button linked to the first rotating shaft and a sealing element linked to the dial button; when the dial button is dialed, the sealing element swings in the horizontal direction in the inlet joint to make at least one of the first function waterway and the second function waterway connected.

In another preferred embodiment, the dial button component comprises a driving element and a linking element, the driving element is disposed in the main body, one end of the driving element extends out of the rear end of the main body to form the first rotating shaft, the other end is linked to the linking element; the linking element is disposed in the inlet joint by a second rotating shaft, the end is disposed with the sealing element.

In another preferred embodiment, the other end of the driving element is disposed with a protruding block, the linking element is disposed with an extending strip having a through groove fitting to the protruding block; the through groove is sleeved on the external periphery of the protruding block; when the dial button is dialed, the protruding block swings in the horizontal direction so as to abut against the groove wall of the through groove, thus driving the linking element to swing about the second rotating shaft.

In another preferred embodiment, the internal wall of the main body is disposed with a groove, one end of a pin is disposed in the groove by a spring; the extending strip has three position holes arranged with space; when the dial button is dialed, the other end of the pin is slidably switched between the three position holes.

In another preferred embodiment, the inlet joint is disposed with an inlet passage in the axial direction of the main body, the inlet joint is further disposed with a chamber vertical to the axis of the main body and connected to the inlet passage.

In another preferred embodiment, the linking element further comprises a hemisphere joint, the extending strip extends outwardly in the horizontal direction of the section of the hemisphere joint; the upper and lower end of the external wall of the hemisphere joint are respectively connected to the internal wall of the chamber by the second rotating shaft.

In another preferred embodiment, one end of the water diversion body is connected to the inlet joint, the other end is disposed with the two outlets, the water diversion body has a first water chamber and a second water chamber independently arranged; the first water chamber and the first outlet form the first function waterway, the second water chamber and the second outlet form the second function waterway.

In another preferred embodiment, the first outlet and the second outlet have height difference in the axial direction of the main body.

In another preferred embodiment, the outlet cover component comprises a cover plate and a decoration cover; the cover plate is disposed with an inner ring outlet connected to the first outlet and an outer ring outlet connected to the second outlet.

In another preferred embodiment, the water diversion body is a water diversion ball, the cover plate has a ball seat connected to the water diversion ball in swinging way; the cover plate swings up and down in the horizontal plane in the accommodating chamber by the cooperation of the ball seat and the water diversion ball.

In another preferred embodiment, the inlet joint is an inlet ball joint, the through hole is disposed with a ball seat connected to the inlet ball joint in swinging way; the main body swings up and down in the horizontal plane by the cooperation of the inlet ball joint and the ball seat.

Compared to the existing known technology, the technical proposal of the present invention has advantages as follow:

First, the overhead shower head of the present invention has a dial button disposed at the eccentric position of the backside of the main body, the dial button can drive the sealing element to swing in the inlet joint in the horizontal direction, so that at least one of the first function passage and the second function passage is connected; therefore it realizes a switch between the first function water, the second function water and the combination of the first and second function water. Compared with the traditional method to switch the function water by rotating the outlet cover plate, the proposal of this embodiment can just achieve that the sealing element swings in a small area in the inlet joint, therefore the dial button has a short rotating route, the operation feeling and the reliability are guaranteed.

Second, as the dial button is disposed at the backside of the main body, it has no linkage relationship with the outlet cover component, when the dial button is dialed, the outlet cover component would not swing, so that the user can operate with his single hand.

Third, the water diversion ball of the overhead shower head has two outlets and two independent water chamber to form the first function waterway and the second function waterway. And the first outlet and the second outlet has height difference in the axis of the main body, therefore, the water diversion ball forms a step water diversion structure. With this configuration, when the cover plate swings to a limit in the accommodating chamber, water can flow correctly out of the first function waterway or the second function waterway without fleeing, it can also ensure the consistent of the outlet mode however the user adjusts the outlet direction of the outlet cover plate.

DETAILED DESCRIPTION OF THE EMBODIMENTS

Figure 1:
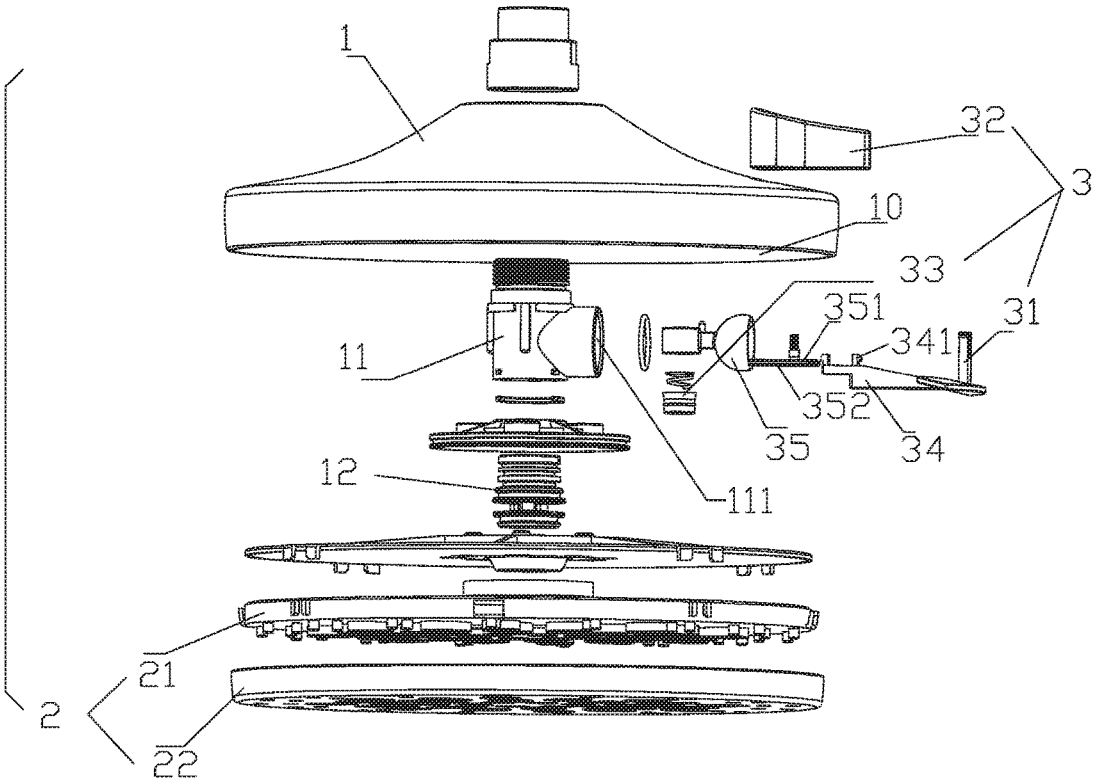
FIG. 1 illustrates an exploded and schematic diagram of the overhead shower head of the first embodiment of the present invention.
Figure 2:
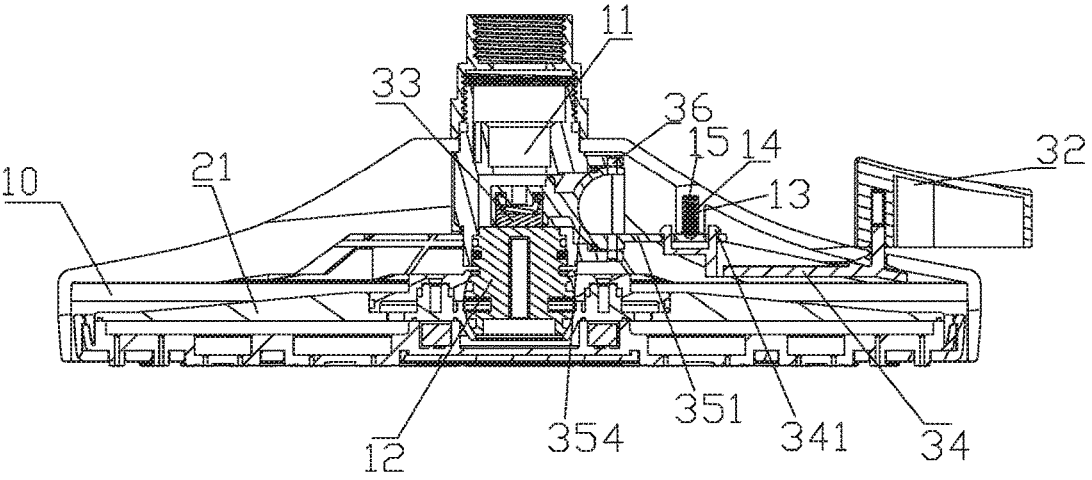
FIG. 2 illustrates a sectional diagram of the overhead shower head of the first embodiment of the present invention.
Figure 3:
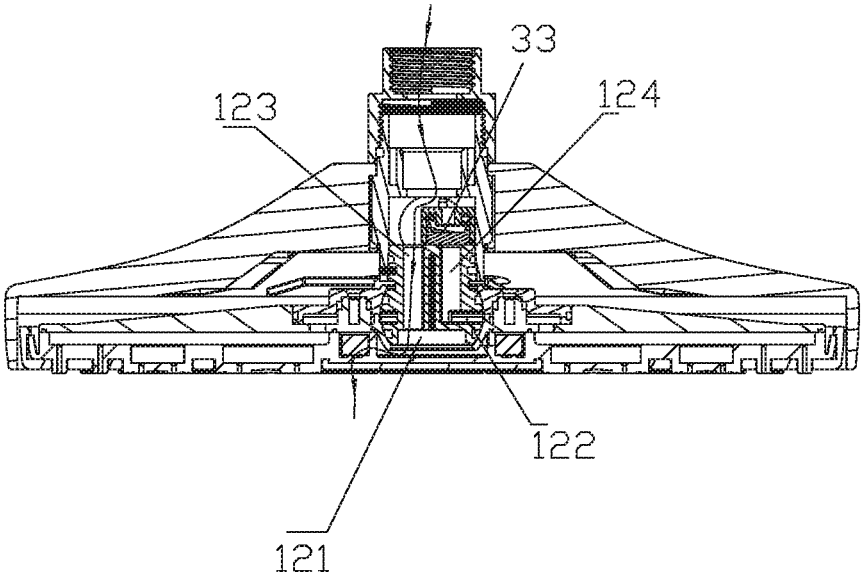
FIG. 3 illustrates a sectional diagram of the overhead shower head of the first embodiment of the present invention when water flows out of the inner ring.
Figure 4:
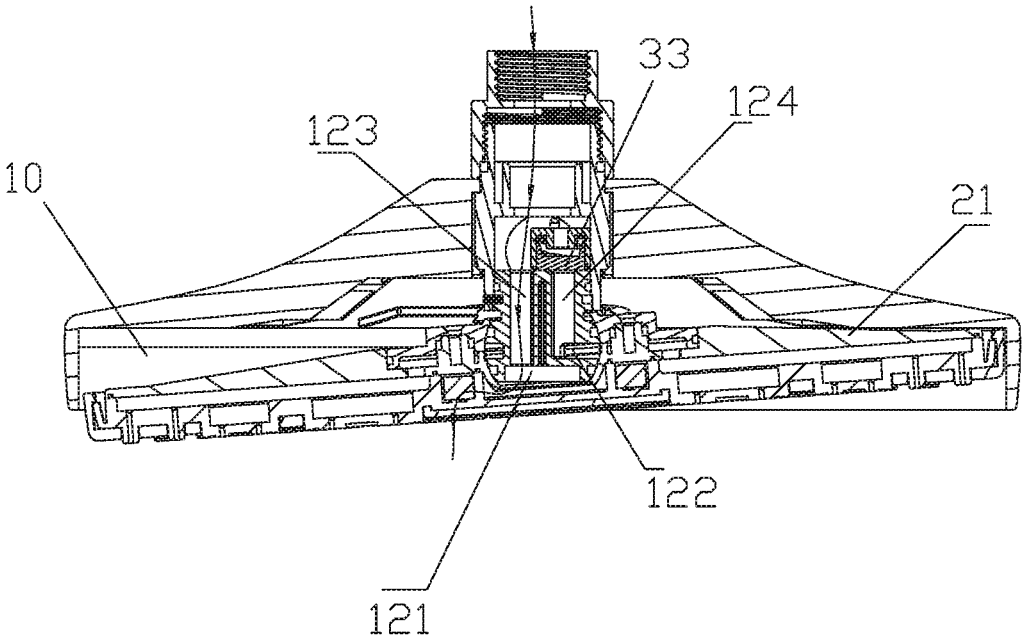
FIG. 4 illustrates a sectional diagram of the swinging of the cover plate of the overhead shower head of the first embodiment when water flows out of the inner ring.
Figure 5:
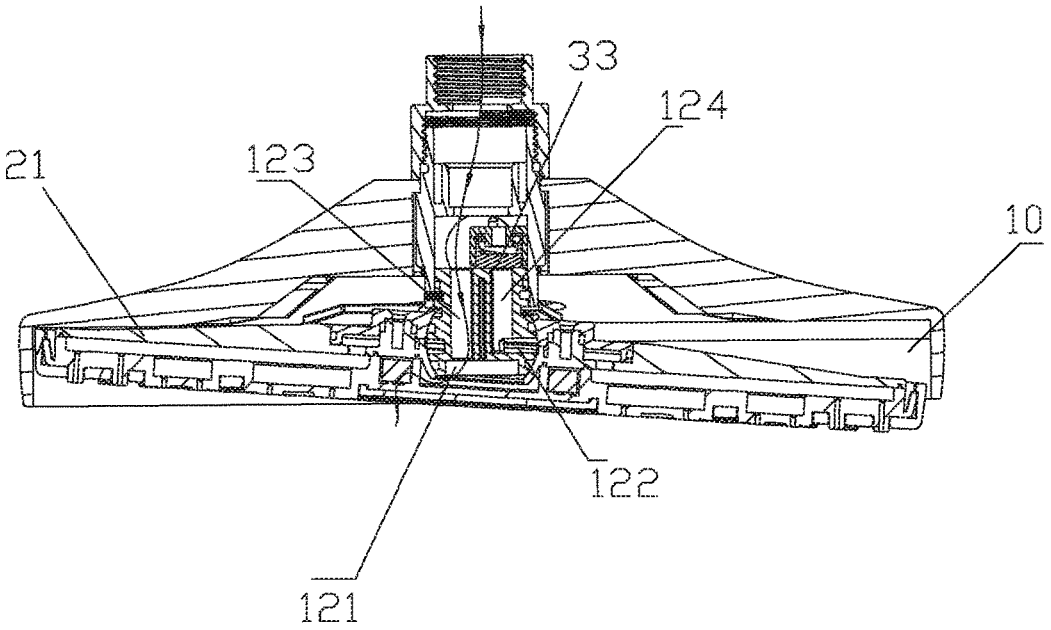
FIG. 5 illustrates another sectional diagram of the swinging cover plate of the overhead shower head of the first embodiment when water flows out of the inner ring.
Figure 6:
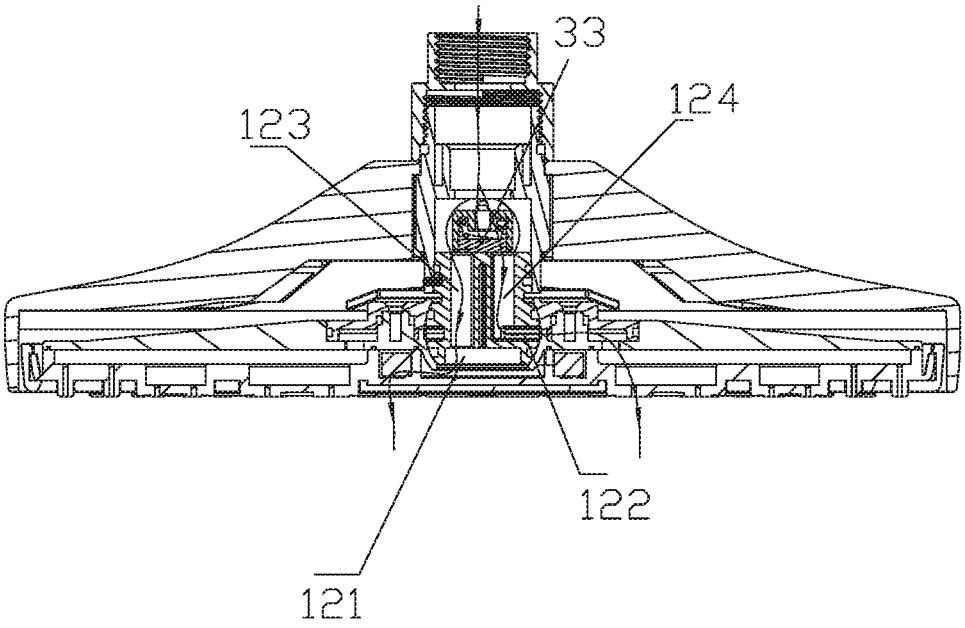
FIG. 6 illustrates a sectional diagram of the overhead shower head of the first embodiment when water flows out of the inner ring and the outer ring.
Figure 7:
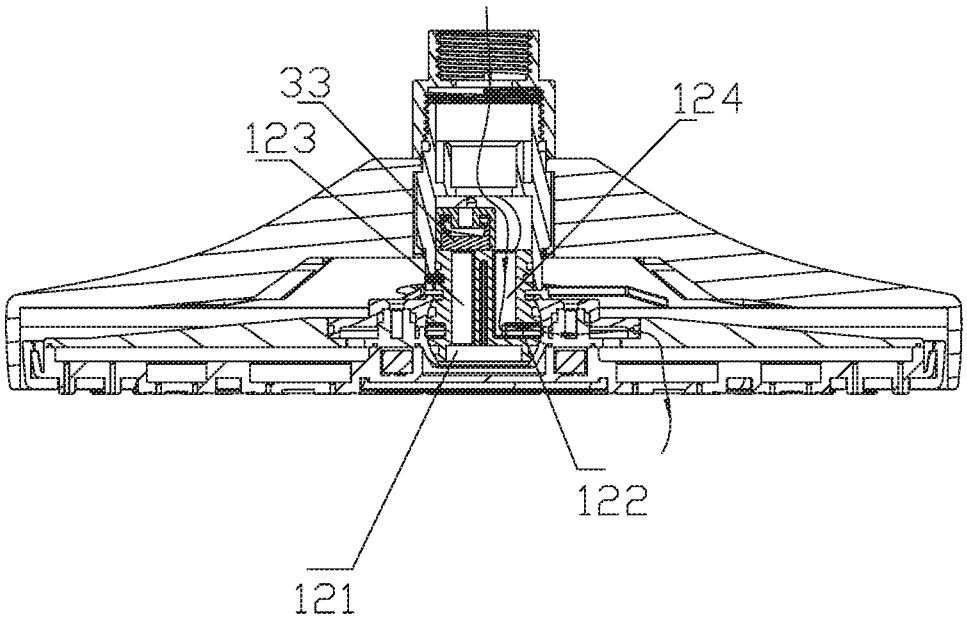
FIG. 7 illustrates a sectional diagram of the overhead shower head of the first embodiment when water flows out of the outer ring.
Figure 8:
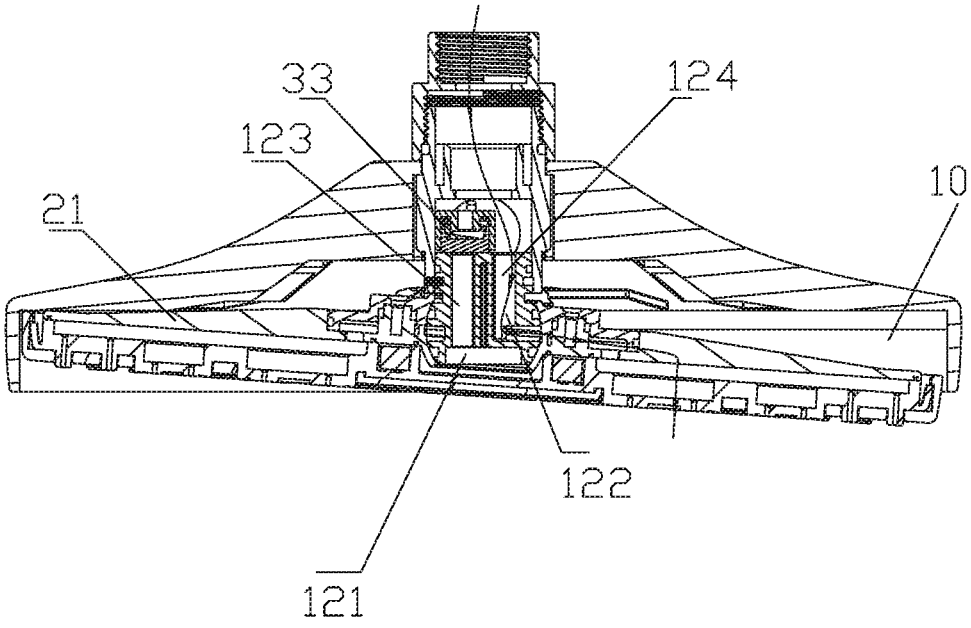
FIG. 8 illustrates a sectional diagram of the swinging cover plate of the overhead shower head of the first embodiment when water flows out of the outer ring.
Figure 9:
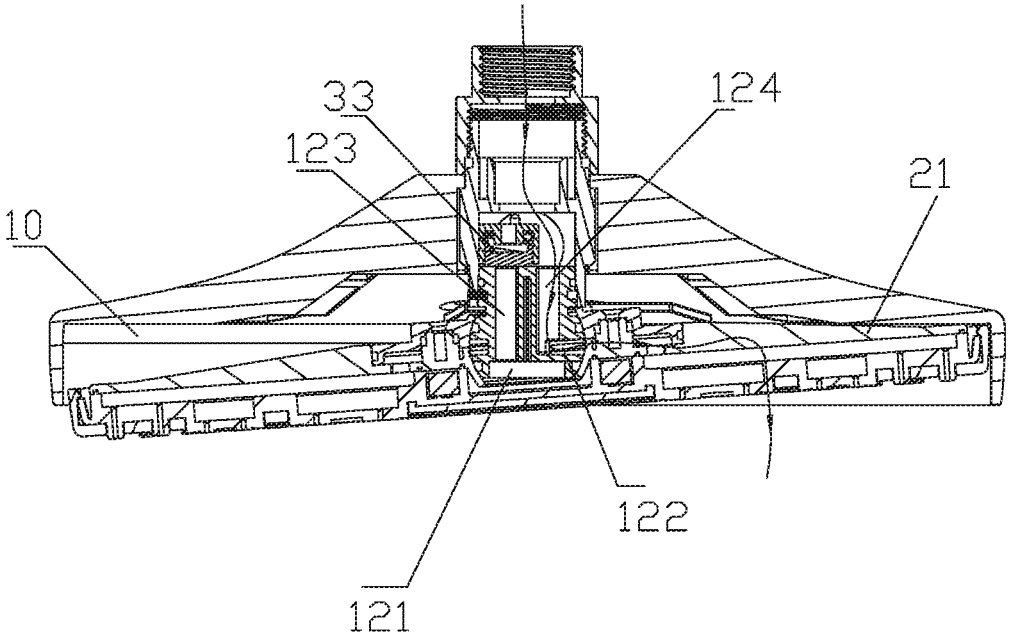
FIG. 9 illustrates another sectional diagram of the swinging cover plate of the overhead shower head of the first embodiment when water flows out of the outer ring.
Figure 10:
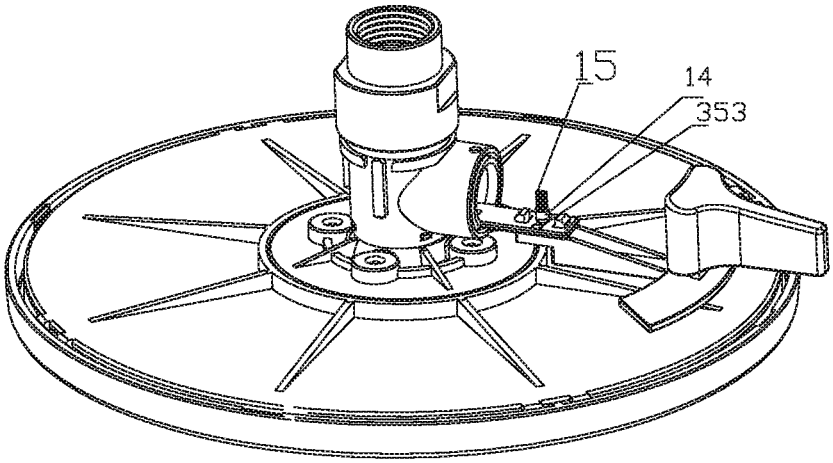
FIG. 10 illustrates a schematic diagram of the pin and the position holes of the first embodiment of the present invention.

The present invention will be described more clearly with the embodiments and the drawings.

The First Embodiment:

Referring to FIGS. 1~10, an overhead shower head with backside switch, the overhead shower head has a main body 1; the front end of the main body 1 is disposed with an accommodating chamber 10 to accommodate an outlet cover component 2, the rear end of the main body is disposed with a dial button component 3 at an eccentric position; the main body 1 is disposed with a through hole in the axial direction of the main body to accommodate an inlet joint 11 and a water diversion body 12; the water diversion body 12 is disposed with a first outlet 121 and a second outlet 122 to form a first function waterway and a second function waterway with the inlet joint 11;

The dial button component 3 comprises a first rotating shaft 31 disposed at an eccentric position, a dial button 32 linked to the first rotating shaft 31 and a sealing element 33 linked to the dial button 32; when the dial button 32 is dialed, the sealing element 33 swings in the horizontal direction in the inlet joint 11 to make at least one of the first function waterway and the second function waterway connected.

Above mentioned overhead shower head has the first rotating shaft 31 disposed at the eccentric position of the backside of the main body 1 and the dial button 32 linked to the first rotating shaft 31, the dial button 32 can drive the first rotating shaft 31 to rotate in the horizontal plane. So that the dial button 32 can drive the sealing element 33 to swing in the inlet joint 11 in the horizontal direction, so that at least one of the first function passage and the second function passage is connected; therefore it realizes a switch between the first function water, the second function water and the combination of the first and second function water. Compared with the traditional method to switch the function water by rotating the outlet cover plate, the proposal of this embodiment can just achieve that the sealing element 33 swings in a small area in the inlet joint 11, therefore the dial button 32 has a short rotating route, the operation feeling and the reliability are guaranteed. Besides, as the dial button 32 is disposed at the backside of the main body 1, it has no linkage relationship with the outlet cover component 2, when the dial button 32 is dialed, the outlet cover component 2 would not swing, so that the user can operate with his single hand.

The dial button component 3 comprises a driving element 34 and a linking element 35, the driving element 34 is disposed in the main body 1, one end of the driving element extends out of the rear end of the main body 1 to form the first rotating shaft 31, the other end is linked to the linking element 35; the linking element 35 is disposed in the inlet joint 11 by a second rotating shaft 36, the end is disposed with the sealing element 33.

To achieve the linkage of the driving element 34 and the linking element 35, the other end of the driving element 34 is disposed with a protruding block 341, the linking element 35 is disposed with an extending strip 351 having a through groove 352 fitting to the protruding block 341; the through groove 352 is sleeved on the external periphery of the protruding block 341. As the first rotating shaft 31 is linked to the dial button 32, when the dial button 32 is dialed, it drives the first rotating shaft 31 to swing in the horizontal direction, thus driving the other end of the linking element 35 to swing in the horizontal direction. Therefore the protruding block 341 swings in the horizontal direction so as to abut against the groove wall of the through groove 352, thus driving the linking element 35 to swing about the second rotating shaft 36. It thus achieves that the sealing element 33 swings in the inlet joint 11 in the horizontal plane.

To achieve a gearing feeling when the user dials the dial button 32 to switch the outlet modes, the internal wall of the main body 1 is disposed with a groove 13, one end of a pin 14 is disposed in the groove 13 by a spring 15; the extending strip 351 has three position holes 353 arranged with space; when the dial button 32 is dialed, the other end of the pin 14 is slidably switched between the three position holes 353 with the spring 15, when the other end of the pin 14 moves out of one position hole 353, the spring 15 is compressed and deformed, and next time the other end of the pin 14 is dropped into the position hole 353, the spring 15 releases energy to make the other end of the pin 14 impact with the internal wall of the next position hole 353 with a snapping sound to remind the user that the switch is finished. And with the spring 15, the user needs a large force to move the pin 14 out of the position hole 353. Therefore, it forms a switch structure with obvious gearing feeling and reminding sound.

The cooperation of the inlet joint 11 and the linking element 35 is as follows: the inlet joint 11 is disposed with an inlet passage in the axial direction of the main body 1, the inlet joint 11 is further disposed with a chamber 111 vertical to the axis of the main body and connected to the inlet passage. The linking element 35 further comprises a hemisphere joint 354, the extending strip 351 extends outwardly in the horizontal direction of the section of the hemisphere joint 354; the upper and lower end of the external wall of the hemisphere joint 354 are respectively connected to the internal wall of the chamber 111 by the second rotating shaft 36. With this structure, the hemisphere joint 354 is disposed in the chamber 111 and linked to the extending strip 351, the sealing element 33 is disposed at the end of the hemisphere joint 354. When the extending strip 351 is pushed by the protruding block 341 to swing in the horizontal direction, the hemisphere joint 354 rotates about the second rotating shaft 36, so that the sealing element 33 in the end of the hemisphere joint 354 swings in the inlet joint 11 in the horizontal direction.

The water diversion body 12 is a water diversion ball with one end connected to the inlet joint 11 and the other end disposed with an first outlet 121 and a second outlet 122, the water diversion body 12 has a first water chamber 123 and a second water chamber 124 independently arranged; the first water chamber 123 and the first outlet 121 form the first function waterway, the second water chamber 124 and the second outlet 122 form the second function waterway.

The outlet cover component 2 comprises a cover plate 21 and a decoration cover 22; the cover plate 21 is disposed with an inner ring outlet connected to the first outlet 121 and an outer ring outlet connected to the second outlet 122.

As the inlet end of the water diversion ball is connected to the inlet joint 11, the sealing element 33 swings in the inlet joint 11 in the horizontal direction, when the sealing element 33 moves to one end of the inlet joint, it separates the second water chamber 124 and the inlet joint 11 in sealing way, so that the second function passage is closed, water flows out of the inner ring outlet of the cover plate 21; when the sealing element 33 moves to the other end, it separates the first water chamber 123 and the inlet joint 11, so that the first function passage is closed, water flows out of the outer ring outlet of the cover plate 21; when the sealing element moves to be between the two ends of the inlet joint 11, the first water chamber 123 and the second water chamber 124 are partly closed by the sealing element 33, so that the first function passage and the second function passage are open at the same time. At this time, water flows out of the inner ring outlet and the outer ring outlet.

In this embodiment, the cover plate 21 has a ball seat connected to the water diversion ball in swinging way; the cover plate 21 swings up and down in the horizontal plane in the accommodating chamber 10 by the cooperation of the ball seat and the water diversion ball. So that it can change the position relationship of the cover plate 21 and the accommodating chamber 10 to adjust the outlet angle of the cover plate 21.

To make sure that the water would not flee and flow correctly out of the inner ring or the outer ring when the cover plate 21 swings, that is to say, the user wants the inner ring water, but part water flows out of the outer ring due to the swinging of the cover plate 21, and also otherwise, the first outlet 121 and the second outlet 122 has height difference in the axis of the main body 1. therefore, the water diversion ball forms a step water diversion structure. With this configuration, when the cover plate 21 swings to a limit in the accommodating chamber 10, water can flow correctly out of the first function waterway or the second function waterway without fleeing, it can also ensure the consistent of the outlet mode however the user adjusts the outlet direction of the outlet cover plate 21.

This embodiment described an overhead shower head with two outlet passages, it should be noted that the shower heads with more than two outlet passages are available to achieve, they are simple substitution of this embodiment.

The Second Embodiment:

This embodiment differs the first embodiment in that: in the first embodiment, the outlet cover plate swings up and down in the horizontal plane, in the second embodiment, the main body 1 can swing up and down in the horizontal plane.

Figure 11:
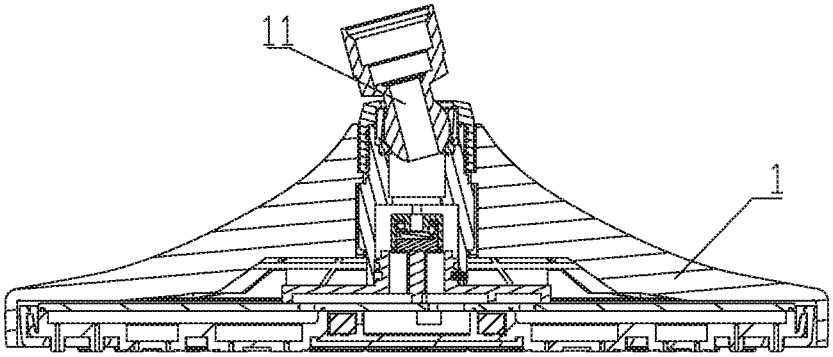
FIG. 11 illustrates a sectional diagram of the swinging shower head main body of the second embodiment of the present invention.

To achieve above mentioned structure, referring to FIG. 11, the inlet joint 11 is an inlet ball joint, the through hole is disposed with a ball seat connected to the inlet ball joint in swinging way; the main body 1 swings up and down in the horizontal plane by the cooperation of the inlet ball joint and the ball seat.

In this embodiment, as the outlet cover plate 21 needn't to swing up and down in the horizontal plane, the water diversion plate needn't to be configured to a water diversion ball but a usual water diversion body 12. The rest part is similar to the first embodiment that it wouldn't further describe.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An overhead shower head, comprising:

a water inlet joint;

a main body extending in an axial direction, having a front and a rear, and having defined therein a through hole in the axial direction, which through hole accommodates the water inlet joint; a water diversion body that is disposed within the main body, that includes a first water chamber and a second water chamber independently disposed within the water diversion body, that has two ends, one end of the two ends being connected to the water inlet joint and another end of the two ends being disposed with a first outlet and a second outlet which have a height difference in the axial direction of the main body, the first water chamber and the first outlet forming a first function waterway, and the second water chamber and the second outlet forming a second function waterway;

an outlet cover including a cover plate disposed with an inner ring outlet connected to the first outlet and an outer ring outlet connected to the second outlet, and a decorative cover;

an accommodating chamber disposed in the front of the main body to accommodate the outlet cover; and a rear switch disposed on the rear of the main body at an eccentric position and including an external dial button, a first rotating shaft disposed at an eccentric position within the main body to which the external dial button is linked; and a sealing element linked to the external dial button so that, when the external dial button is moved, the sealing element moves in a horizontal direction within the water inlet joint to connect to at least one of the two outlets of the water diversion body to supply water to at least one of the first function waterway and the second function waterway, wherein the water diversion body is a water diversion ball, and wherein the cover plate of the outlet cover has a ball seat that is movably connected to and cooperates with the water diversion ball, the ball seat being swingable relative to the water diversion ball within the ball seat to move the cover plate with respect to a horizontal plane within the accommodating chamber.

* * * * *